US010980316B2

(12) United States Patent
Nonogawa et al.

(10) Patent No.: US 10,980,316 B2
(45) Date of Patent: Apr. 20, 2021

(54) SHOES

(71) Applicant: ASICS CORPORATION, Kobe (JP)

(72) Inventors: Mai Nonogawa, Kobe (JP); Masashi Isobe, Kobe (JP); Seigo Nakaya, Kobe (JP); Fumitaka Kamifukumoto, Kobe (JP); Hiroaki Nishimura, Kobe (JP)

(73) Assignee: ASICS CORPORATION, Kobe (JP)

( * ) Notice: Subject to any disclaimer, the term of this patent is extended or adjusted under 35 U.S.C. 154(b) by 505 days.

(21) Appl. No.: 14/910,367

(22) PCT Filed: Aug. 7, 2013

(86) PCT No.: PCT/JP2013/071415

§ 371 (c)(1),
(2) Date: Feb. 5, 2016

(87) PCT Pub. No.: WO2015/019451

PCT Pub. Date: Feb. 12, 2015

(65) Prior Publication Data

US 2016/0174661 A1 Jun. 23, 2016

(51) Int. Cl.
*A43B 23/02* (2006.01)

(52) U.S. Cl.
CPC ..... *A43B 23/0235* (2013.01); *A43B 23/027* (2013.01); *A43B 23/0245* (2013.01); *A43B 23/0265* (2013.01)

(58) Field of Classification Search
None
See application file for complete search history.

(56) References Cited

U.S. PATENT DOCUMENTS

| | | | | |
|---|---|---|---|---|
| 2006/0162190 | A1 | 7/2006 | Nishiwaki et al. | |
| 2007/0031667 | A1 | 2/2007 | Hook et al. | |
| 2009/0241374 | A1 | 10/2009 | Sato et al. | |
| 2010/0269369 | A1 | 10/2010 | Nishiwaki et al. | |
| 2011/0041362 | A1 | 2/2011 | Nishiwaki et al. | |
| 2012/0142239 | A1 | 6/2012 | Budden et al. | |
| 2014/0059734 | A1 * | 3/2014 | Toronjo | A41D 31/0016 2/69 |

FOREIGN PATENT DOCUMENTS

| | | | |
|---|---|---|---|
| JP | H09-182602 | A | 7/1997 |
| JP | 2005-329270 | A | 12/2005 |
| JP | 2006-525443 | A | 11/2006 |
| JP | 2012-513489 | A | 6/2012 |
| WO | 2008/047659 | A1 | 4/2008 |
| WO | 2009/122821 | A1 | 10/2009 |

OTHER PUBLICATIONS

Office Action of Japanese corresponding application No. 2015-530609 dated Apr. 18, 2017 and English translation thereof.

* cited by examiner

*Primary Examiner* — Megan E Lynch
(74) *Attorney, Agent, or Firm* — Muncy, Geissler, Olds & Lowe, P.C.

(57) ABSTRACT

An object of the present invention is to provide shoes with good fitting property.
The present invention provides a shoe including: a sole 1 which absorbs landing impact; and an upper 2 which covers an instep of a foot. The upper has a first opening 3 through which the foot is inserted when wearing the shoe. The upper 2 is partly or entirely made of a material which has negative Poisson's ratios.

6 Claims, 13 Drawing Sheets

SHOES

TECHNICAL FIELD

The present invention relates to shoes with improved fitting property.

BACKGROUND ART

Functions required of shoes, such as athletic shoes, include fitting property. The fitting property may be improved by, for example, reducing wrinkle occurrence, decreasing contact pressure values, improving contact condition between the foot and the shoe upper, and improving the upper to better follow foot deformation behavior.

Generally, the upper is designed in consideration of a stationary shape of a foot. In conventional shoes, the entire upper is made of a low-stiffness material in an attempt to decrease contact pressure values. However, the upper made of a low-stiffness material cannot distribute shoe lace tightening force which is exerted at eyelets throughout the entire upper, resulting in poor contact condition between the foot and the upper.

Another attempt which has been tried was to reduce large wrinkle occurrences which can develop in the upper during activities. Specifically, a shoe includes a mesh member which is reinforced with a urethane resin for dispersed occurrence of small wrinkles. However, the arrangement does not provide a fundamental solution to the object of reducing wrinkles.

Another attempt to reduce wrinkles in the upper of a shoe for improved fitting property between the shoe and the foot is disclosed in Patent Literature 1.

According to this shoe disclosed in Patent Literature 1, a stretching fabric is used in the upper. The stretching fabric is stretched, and then integrated with the sole under this state. Since the upper of the shoe is under a shrinking force, there is less occurrence of wrinkles in the upper even when the foot is bent during activities such as running.

One consideration to be noted here is that during activities, the shape of the foot is constantly changing. In other words, during activities, the upper is often not able to follow the foot deformation behavior, resulting in separation of the shoe sole from the foot. On the contrary, there can also be cases where the upper works as a constraint on natural foot deformation behavior. Therefore, when the upper is considered as a part which makes the sole follow the foot, it is desirable that the upper is able to change its shape following the foot deformation behavior during activities.

In other words, fitting property is required of the shoes because the foot changes its shape during activities. In order to improve the fitting property, it is desirable that the upper has a strain distribution which is similar to a strain distribution in the foot during activities.

The applicant of this invention has already proposed athletic shoes with improved fitting property (see Patent Literature 2).

The athletic shoes disclosed in Patent Literature 2 includes a sole which absorbs landing impact; and an upper which covers the instep of the foot. The upper includes a first opening which exposes the foot upward when the shoe is worn, and a second opening which is closed with a tongue piece. The two openings are continuous with each other in a fore-aft direction. The upper includes an inner stretching region covering part of an inner-side surface of the foot, an outer stretching region covering part of an outer-side surface of the foot, a front region ahead of the two stretching regions, and a rear region behind the two stretching regions. Each of the stretching regions has a smaller Young's module than the front region and the rear region. Also, the outer stretching region covers a region ranging from the fifth metatarsal distal bone head or a region nearby to the second opening.

The arrangement described above, i.e., that the outer stretching region is on an area essentially at or near an upper end of the fifth metatarsal distal bone head, means that a stretching material covers the region of the foot where strain distribution can change drastically. This allows the upper to change its shape in accordance with shape changes of the region and improves fitting property.

CITATION LIST

Patent Literature

Patent Literature 1: WO2009/122821 Gazette
PATENT LITERATURE 2: JP-A 2005-329270 Gazette

SUMMARY OF INVENTION

Technical Problem

The shoes disclosed in Patent Literatures 1 and 2 still cannot sufficiently reduce occurrence of wrinkles. The present invention was made to eliminate the problem described above, with an object to provide shoes with good fitting property having such an advantage as reduced occurrence of wrinkles.

Solution to Problem

The present invention provides a shoe including: a sole which absorbs landing impact; and an upper which covers an instep of a foot. In this arrangement, the upper has a first opening through which the foot is inserted when wearing the shoe, and the upper is partly or entirely made of a material which has negative Poisson's ratios.

The upper may also have a second opening closed by a tongue piece above the instep. In this arrangement, the first opening and the second opening are continuous with each other in a fore-aft direction, and the upper is partly or entirely made of the material which has negative Poisson's ratios, excluding a tightening region near the second opening.

The material which has negative Poisson's ratios may be provided by a single layer of negative Poisson's ratios structure.

Also, the material which has negative Poisson's ratios may be provided by a plurality of layers, with at least one of the plurality of layers having the negative Poisson's ratios structure. For example, a material which has a greater stiffness than a main material of the upper is used to form the layer of the negative Poisson's ratios structure, and on one side thereof, there may be laminated another layer which may be a mesh material having a lower stiffness than the material of said greater stiffness or a highly stretchable material. Also, a material which has a greater stiffness than a main material of the upper is used to form the layer of the negative Poisson's ratios structure, and on both sides thereof, there may be laminated another layer which may be a mesh material having a lower stiffness than the material of said greater stiffness or a highly stretchable material.

The negative Poisson's ratios structure may be a net-like structure made of a plurality of rows of square-shaped frames, with each square-shaped frame having a pair of two mutually opposing sides out of four being close from each other in their center regions, and the rows being offset from each other by a half of a pitch of the square-shaped frame.

The upper has an instep region, where the material having negative Poisson's ratios may be used so that the row direction of the negative Poisson's ratios structure is oriented in a fore-aft direction of the shoe.

The upper has a region of the first metatarsophalangeal joint, where the material having negative Poisson's ratios may be used so that the row direction of the negative Poisson's ratios structure is oriented in an up-down direction of the shoe.

The upper has an region of the fifth metatarsophalangeal joint, where the material having negative Poisson's ratios may be used so that the row direction of the negative Poisson's ratios structure is oriented in an up-down direction of the shoe.

The upper has a heel region, where the material having negative Poisson's ratios may be used so that the row direction of the negative Poisson's ratios structure is oriented in an up-down or fore-aft direction of the shoe.

The upper has a tongue piece, where the material having negative Poisson's ratios is used so that the row direction of the negative Poisson's ratios structure is oriented in a fore-aft direction of the shoe The upper has a midfoot region, where the material having negative Poisson's ratios may be used so that the row direction of the negative Poisson's ratios structure is oriented in a fore-aft direction of the shoe.

Advantageous Effects of Invention

The present invention makes it possible to improve fitting property by making the upper partly or entirely of a material which has negative Poisson's ratios. Specifically, wrinkle occurrence is reduced, contact pressure values are decreased, contact condition between the upper and the foot is maintained, and the foot and the upper deform their behavior in the same pattern, resulting in better fitting property.

DESCRIPTION OF EMBODIMENTS

Hereinafter, embodiments of the present invention will be described in detail with reference to the drawings. It should be noted here that throughout the drawings the same or equivalent parts and components will be indicated with the same reference symbols, and in order to avoid redundancy in description, their description will not be repeated.

Figure 1:
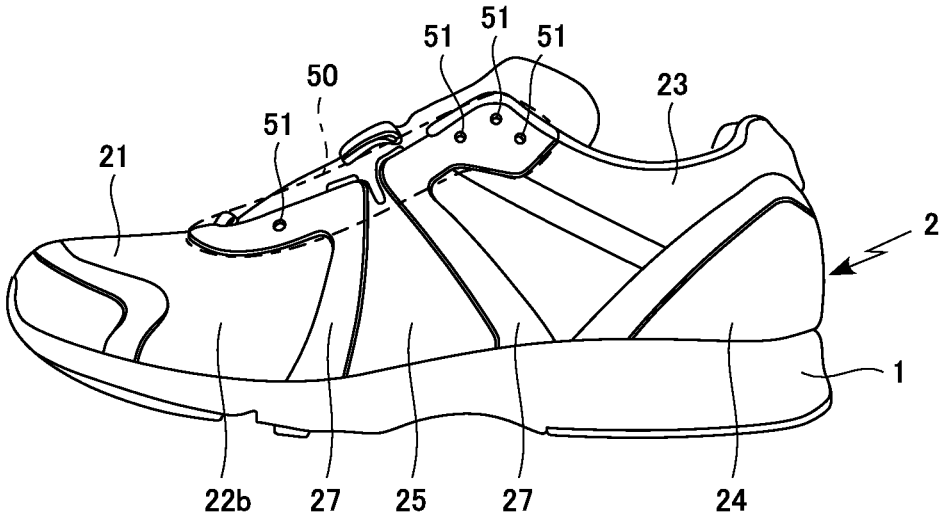
FIG. 1 shows an inner side of a shoe (right foot) to which a first embodiment of the present invention is applied.
Figure 2:
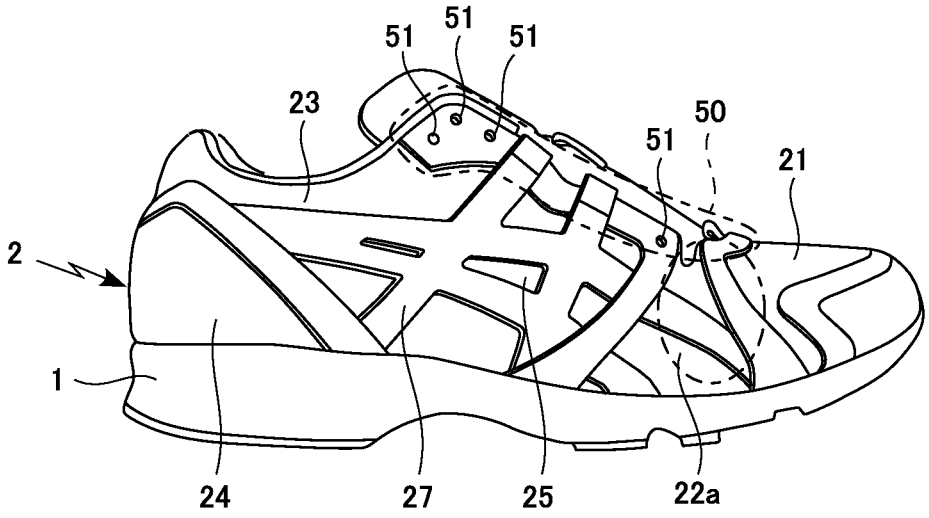
FIG. 2 shows an outer side of the shoe (right foot) to which the first embodiment of the present invention is applied.
Figure 3:
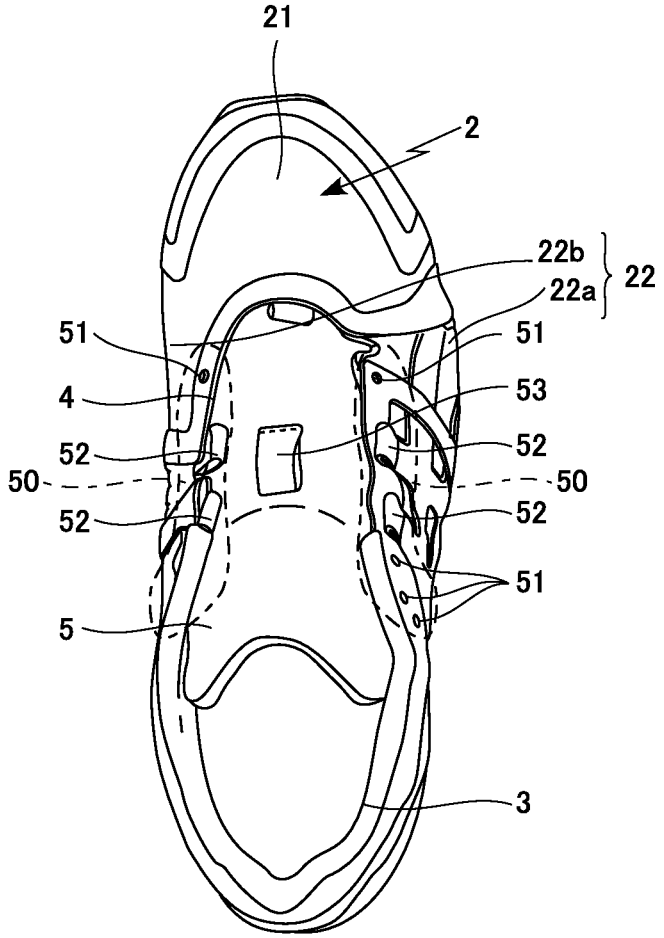
FIG. 3 is a top view of the shoe (right foot) to which the first embodiment of the present invention.
Figure 4:
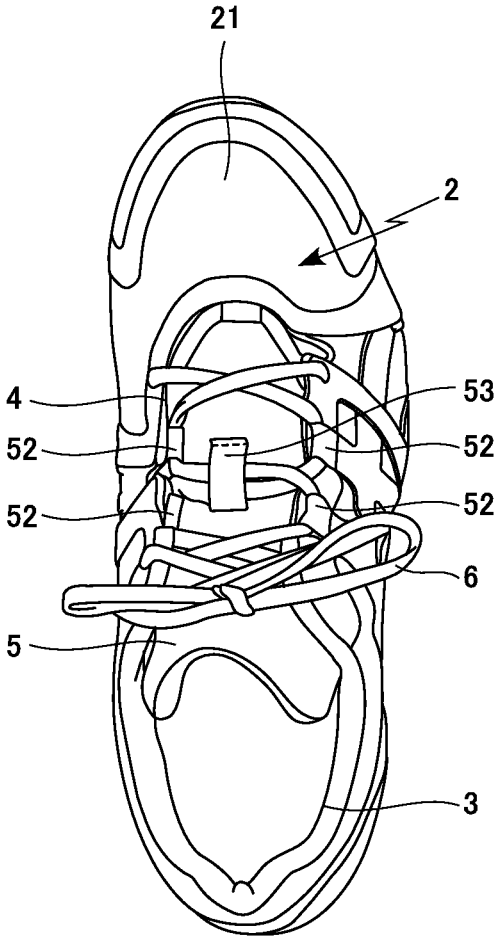
FIG. 4 is a top view of the shoe (right foot) to which the first embodiment of the present invention is applied, with its shoe lace tightened.

FIG. 1 through FIG. 4 show a shoe (right foot) to which a first embodiment of the present invention is applied. FIG. 1 shows an inner side surface of the shoe according to the first embodiment, FIG. 2 shows an outer side surface thereof, and FIG. 3 shows an upper surface thereof, whereas FIG. 4 shows a top view thereof, with a tightened shoe lace.

As shown in FIG. 1 through FIG. 4, the shoe includes a sole 1 and an upper 2. The upper 2 has a first opening 3 and a second opening 4.

As shown in FIG. 3, the first opening 3 and the second opening 4 are formed in a center of the upper 2. The first opening 3 is an opening which exposes the foot upward when the shoe is worn. The second opening 4 is an opening which is closed with a tongue piece 5. The first opening 3 is behind the second opening 4 and is continuous to the second opening 4. The second opening 4 covers a fore region of an instep.

The tongue piece 5 is sewn to the upper 2 ahead of the second opening 4. At a center of an upper surface of the tongue piece 5, a tube-like loop 53 is provided. When the shoe is worn, the shoe lace 6 is inserted through the loop 53 as shown in FIG. 4.

The upper 2 has an instep region 21 between the toe and the tongue piece 5; a fore-foot region 22; a heel region (ankle sponge) 23 around the first opening 3; a heel region (heel counter) 24 between the heel region (ankle sponge) 23 and the sole 1; an region of the fifth metatarsophalangeal joint 22*a*; and a midfoot region 25 between a region of the first metatarsophalangeal joint 22*b* and the heel region 23. The fore-foot region 22 includes the region of the fifth metatarsophalangeal joint 22*a* at a location corresponding to the antithenar, and the region of the first metatarsophalangeal joint 22*b* at a location corresponding to the hallux. A line marker 27 is provided in the midfoot region 25. It should be noted here that the region of the fifth metatarsophalangeal joint 22*a* and the region of the first metatarsophalangeal joint 22*b* may be collectively called the fore-foot region 22.

Along two sides of the second opening 4, a pluralities of eyelet regions 51 and loop regions 52 are provided. The shoe lace 6 is inserted through these eyelet regions 51 and the loop regions 52 and then the lace is tightened. These eyelet regions 51 and loop regions 52 constitute a tightening region 50 for transmitting a tightening force of the lace. For transmitting the tightening force of the lace, the tightening region 50 is made of a material having a predetermined stiffness.

When the shoe is worn around a foot, the shoe lace 6 in FIG. 4 is loosened, and the foot is inserted into the shoe from the first opening 3 and a rear portion of the second opening 4.

Figure 5:
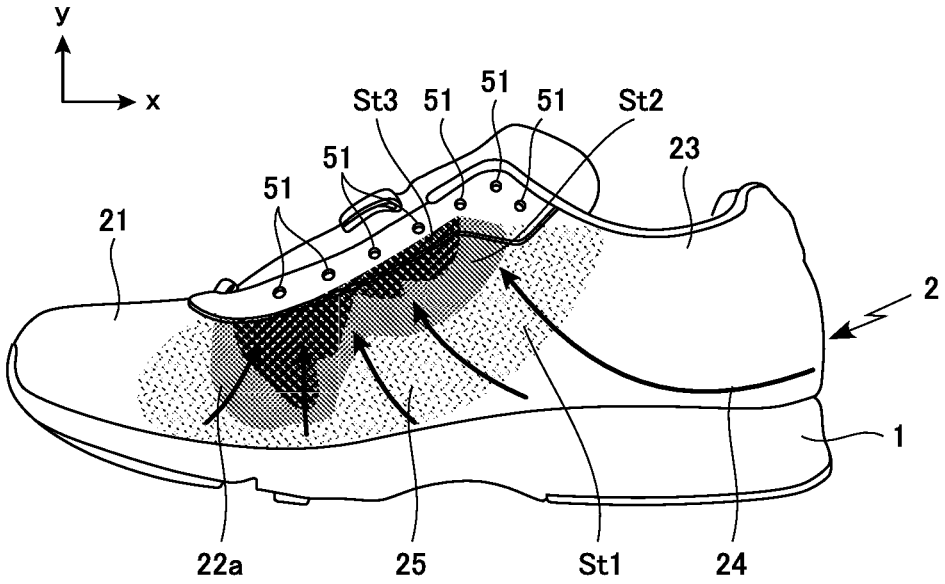
FIG. 5 is a diagrammatic representation showing a strain distribution in an entire outer side surface of the upper (left foot) whose shape is changed as the lace is tightened.
Figure 6:
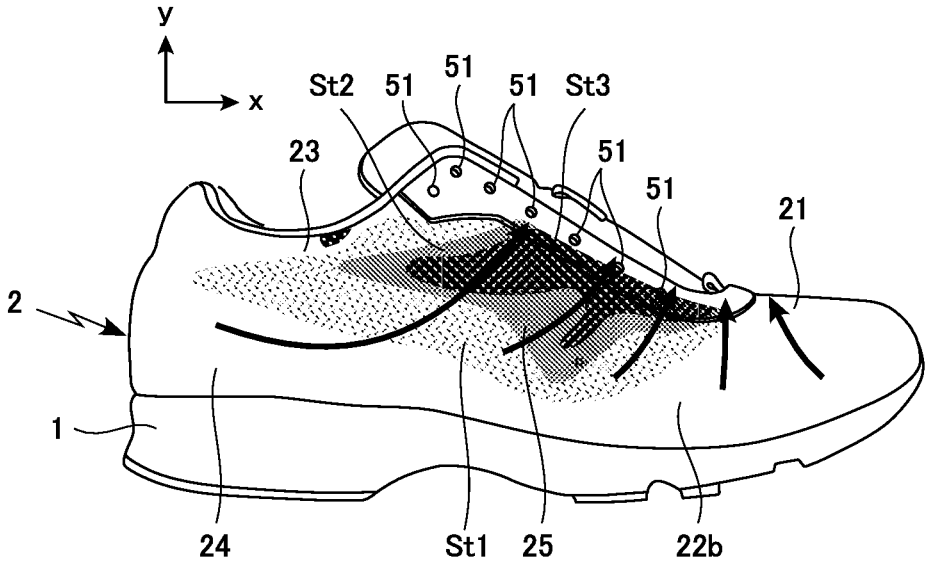
FIG. 6 is a diagrammatic representation showing a strain distribution in an entire inner side surface of the upper (left foot) whose shape is changed as the lace is tightened.
Figure 7:
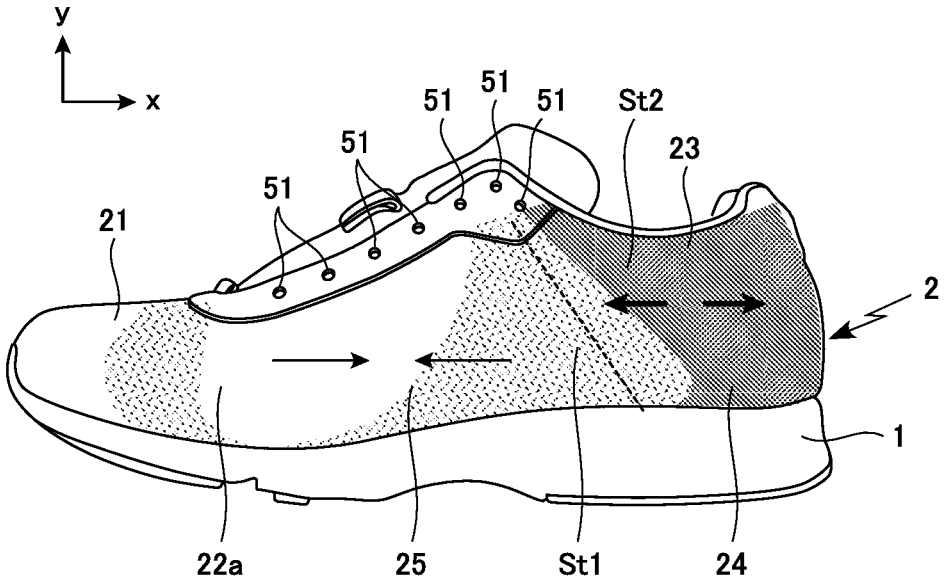
FIG. 7 is a diagrammatic representation showing a strain distribution in Direction X in the outer side surface of the upper (left foot) whose shape is changed as the lace is tightened.
Figure 8:
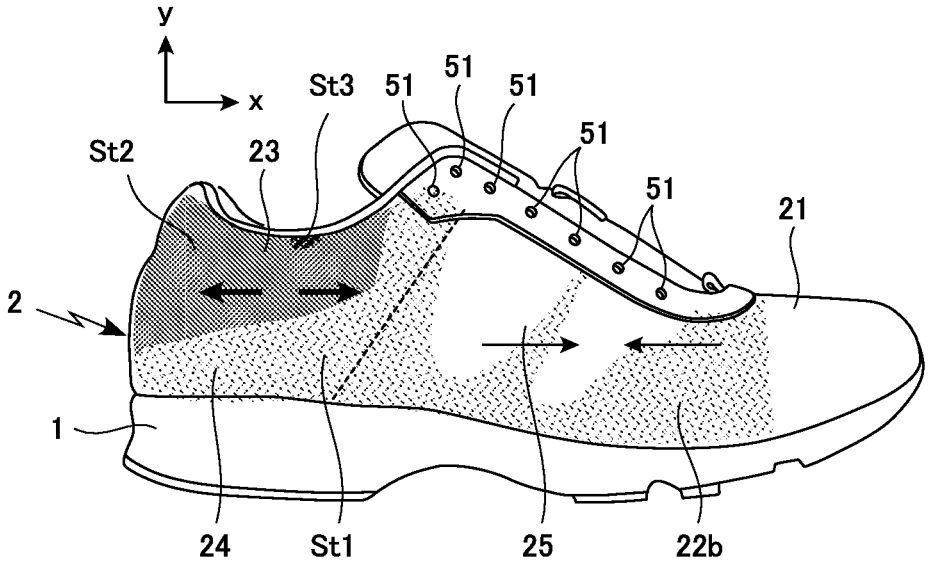
FIG. 8 is a diagrammatic representation showing a strain distribution in Direction X in the inner side surface of the upper (left foot) whose shape is changed as the lace is tightened.
Figure 9:
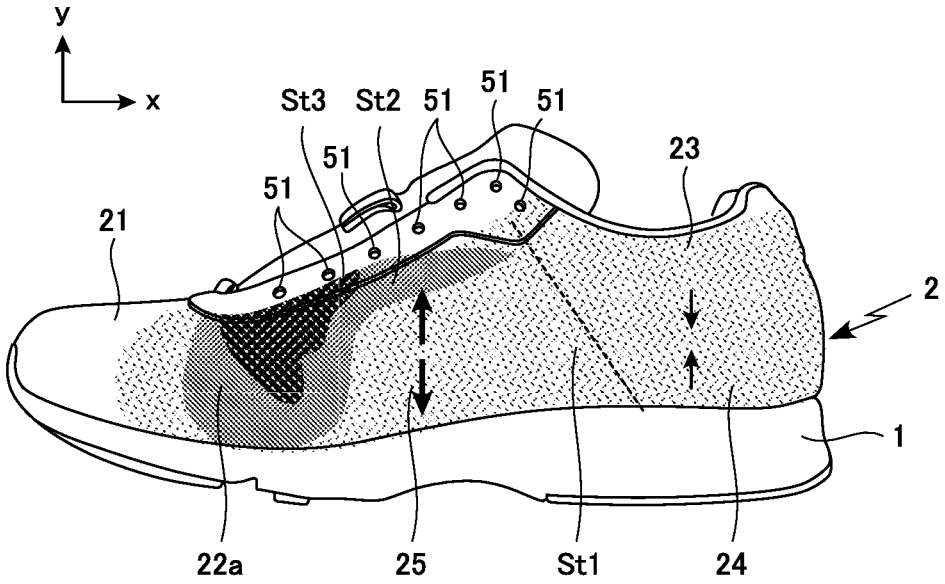
FIG. 9 is a diagrammatic representation showing a strain distribution in Direction Y in the outer side surface of the upper (left foot) whose shape is changed as the lace is tightened.
Figure 10:
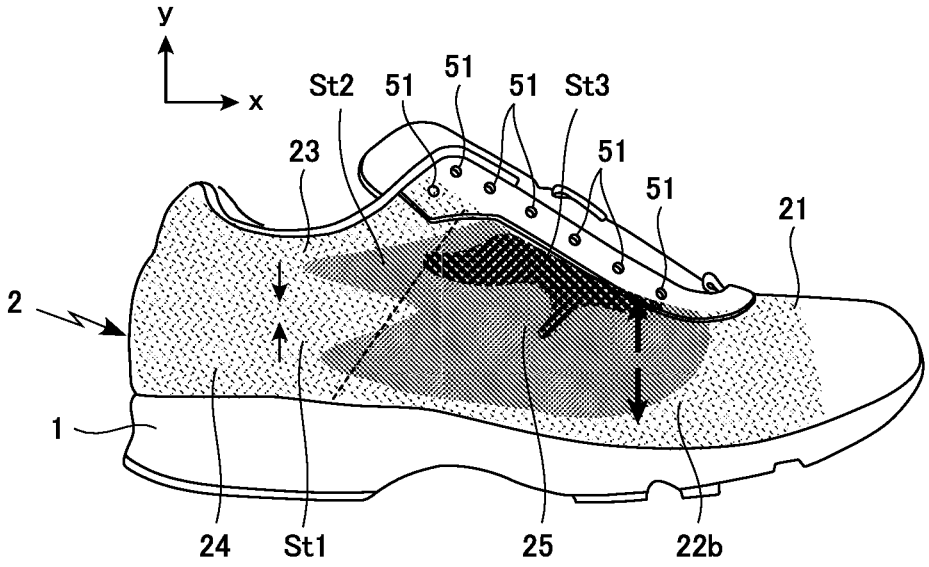
FIG. 10 is a diagrammatic representation showing a strain distribution in Direction Y in the inner side surface of the upper (left foot) whose shape is changed as the lace is tightened.

FIG. 5 through FIG. 10 are diagrammatic representations showing a strain distributions in the upper (left foot) whose shape is changed as the lace is tightened. When a commonly available shoe, whose upper 2 is made by laminating woven and/or knitted fabrics (preferably bonded to each other), is worn and the lace is tightened, a shape change occurs as shown in FIG. 5 through FIG. 10. FIG. 5 shows a strain distribution over the entire outer side surface of the upper 2, FIG. 6 shows a strain distribution over the entire inner side surface of the upper 2. Areas indicated with a reference symbol St3 are areas having the highest strains of approximately 15 percent. Areas indicated with a reference symbol St2 are those having approximately 8 through 10 percent of strain, whereas areas indicated with a reference symbol St1 have approximately 4 through 8 percent of strain. FIG. 7 shows a strain distribution in Direction X in the outer side surface of the upper 2, FIG. 8 shows a strain distribution in direction X in the inner side surface of the upper 2, FIG. 9 shows a strain distribution in direction Y in the outer side surface of the upper 2, and FIG. 10 shows a strain distribution in direction Y in the inner side surface of the upper 2.

When the shoe is worn and the lace is tightened, as shown in FIG. 5 through FIG. 10, the lace tightening region 50 which includes the eyelet regions 51 changes its shape in Direction Y in the figure. Along with this, the heel region 24 changes its shape in Direction −X, while the fore-foot region 22 changes its shape in Direction X. This is because the upper 2 is made of a material which has a positive Poisson's ratio. Poisson's ratio as used here is defined as a negative value of a quotient given by dividing a lateral strain by a vertical strain. The Poisson's ratio is unique to a material.

Figure 11:
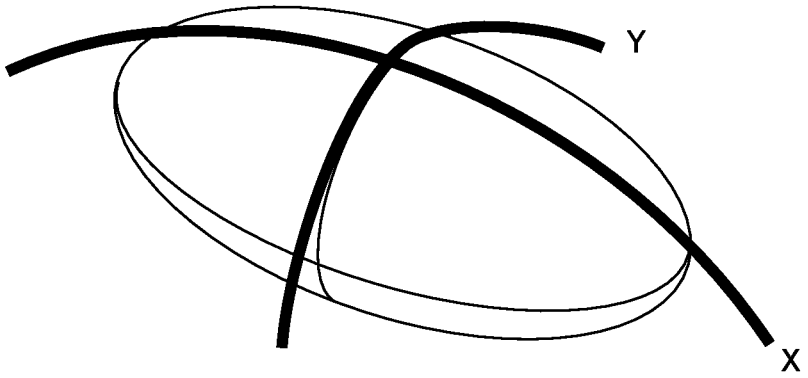
FIG. 11 is an explanatory view showing forces involved when a three-dimensional object is covered with a plane.

As a simulation of the upper 2 covering the foot, assume a plane covering a tree-dimensional object. Then it is understood that as shown in FIG. 11, the upper 2 must be pulled in both X and Y directions.

A contact pressure value in this state is given by the following calculation:

$$\text{Contact pressure value} = Rx \cdot Fx + Ry \cdot Fy \quad (1)$$

where, R represents curvature whereas F represents external force.

When a material which has negative Poisson's ratios, on the other hand, is pulled in Direction Y, the material also stretches in Direction X, so it can cover the foot without being pulled in Direction X.

As described above, if a material which has negative Poisson's ratios is used, it becomes possible to cover the foot by pulling it in Direction Y without pulling in Direction X. This means that when calculating a contact pressure value with the Mathematical Expression (1), the first item has a value of zero. Therefore, if a material which has negative Poisson's ratios is used, it becomes possible to reduce the contact pressure value when covering the foot, and thereby improve pressing contact onto the foot.

The present invention was made based on the above-described knowledge, and provides an arrangement that except for the tightening region 50 which is near the second opening 4 and serves as a region for transmitting the lace tightening force, the upper 2 is partly or entirely made of a material having negative Poisson's ratios. The arrangement described above makes it possible to transmit the lace tightening force, improve contact condition between the upper and the foot, decrease the contact pressure values, and improve fitting property.

Figure 12:
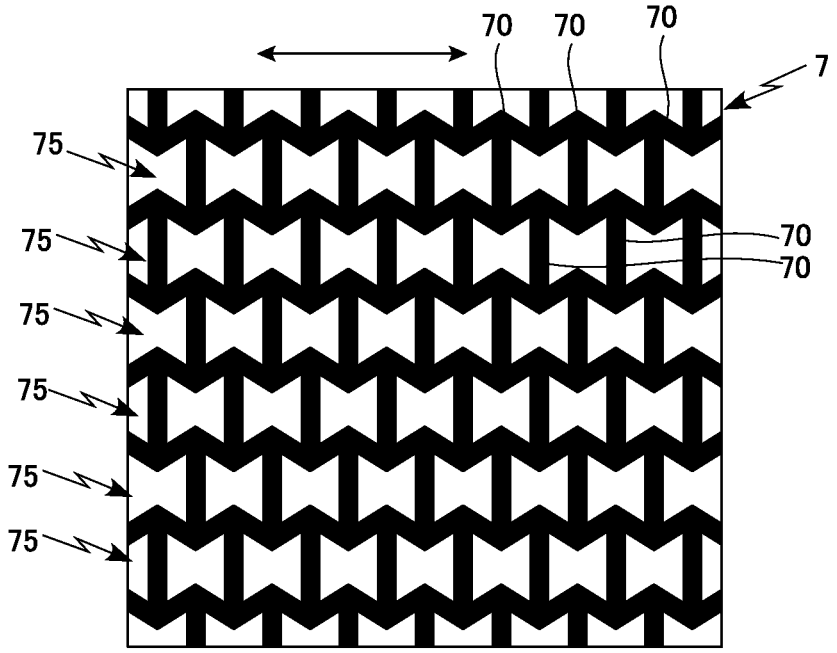
FIG. 12 is plan view as a diagrammatic representation showing a structure of a material which has negative Poisson's ratios.

Among various proposals for a material 7 which has negative Poisson's ratios including those having a special, honeycomb-like structure and those having a composite, artificial structure called bubble structure, etc., one example is as shown in FIG. 12. This negative Poisson's ratios structure is a net-like structure made of a plurality of rows 75 of square-shaped frames 70, each having a pair of two mutually opposing sides out of four sides being close from each other in their center regions. The rows are offset from each other by a half of a pitch of the square-shaped frame 70. It should be noted here that the row direction represents a direction which is vertical to a direction in which the two mutually closer sides in the square-shaped frames 70 are connected to each other (direction indicated by an arrow in FIG. 12).

Figure 13:
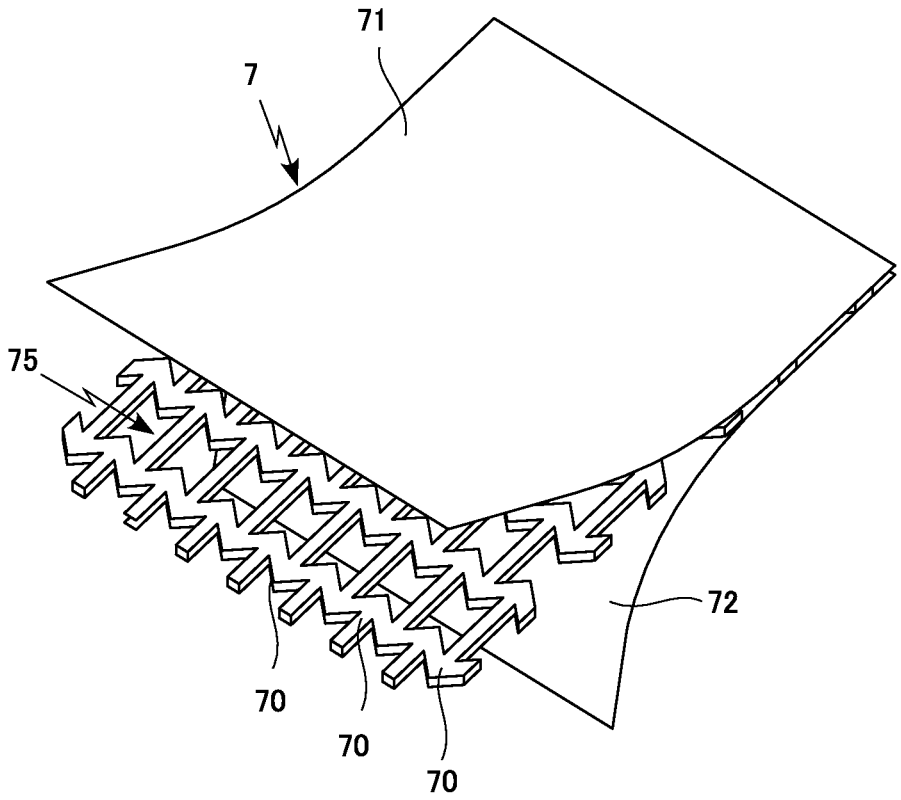
FIG. 13 is perspective view as a diagrammatic representation showing a structure of the material which has negative Poisson's ratios.

The material 7 which has negative Poisson's ratios and is used for the upper 2 may be provided by a single layer of a material which has the negative Poisson's ratios structure as shown in FIG. 12, or may be provided by a laminated member of a plurality of layers, in which case at least one of the layers has negative Poisson's ratios structure. An example of the laminated material made of a plurality of layers is shown in FIG. 13. An artificial leather, urethane resin or other material which has an appropriate stiffness is used to form a layer of the negative Poisson's ratios structure in which a plurality of square-shaped frames 70 are arranged in a net-like pattern. On one or both sides of the negative Poisson's ratios structure layer, there may be provided other layers 71, 72 which may be a mesh material or a highly stretchable material, and has a lower stiffness than the material that provides the layer of the square-shaped frames 70 arranged in the net pattern.

The material which has negative Poisson's ratios and is provided as a laminated member made by laminating a plurality of layers includes a layer having negative Poisson's ratios structure; and the other layers laminated there on provided by materials which do not obstruct shape changes of the negative Poisson's ratios structure layer so that the laminated member as a whole has negative Poisson's ratios.

As a simulation of an action which occurs during activities, consider a case where the heel is raised while a forefoot region of the sole 1 is kept in contact with the ground. Since the instep region 21 is squeezed in the anterior-posterior direction while stretched in the mediolateral direction, wrinkles develop. If a material 7, which has negative Poisson's ratios, is disposed at the instep region 21 of the upper 2, these wrinkles do not develop because the material is squeezed in the mediolateral direction simultaneously when squeezed in the anterior-posterior direction. Therefore, use of a material which has negative Poisson's ratios makes it possible to reduce occurrence of wrinkles.

Figure 14:
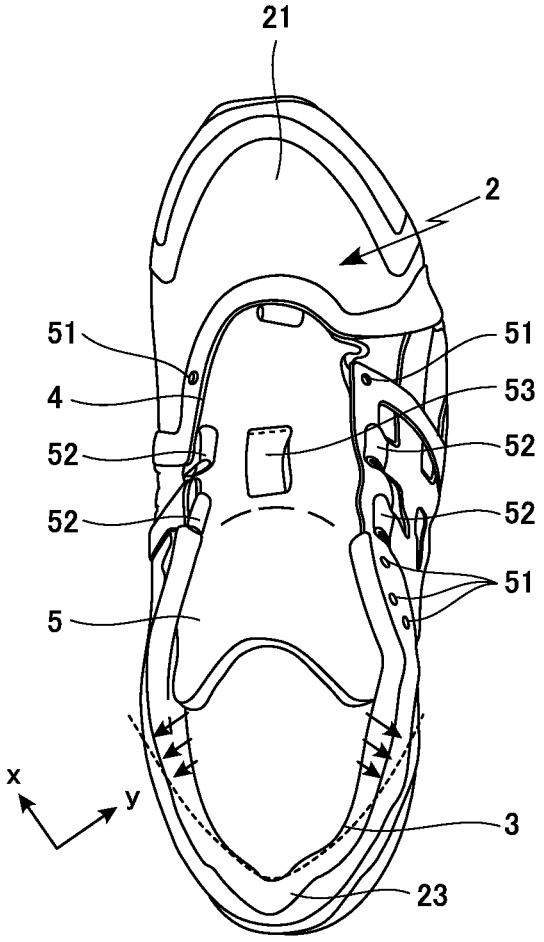
FIG. 14 is a diagrammatic representation showing how a heel region of an upper (right foot) changes its shape upon landing on the heel.

When landing on the heel during running activities, as shown in broken lines in FIG. 14, the heel region (ankle sponge) 23 of the upper (right foot) 2 is stretched in Direction X while compressed in Direction Y.

When the heel region (ankle sponge) 23 of the upper 2 is compressed in Direction Y, a gap between the heel region 23 of the upper 2 and the foot is increased, which can pose a concern of reduced fitting property of the heel region 23. However, if a material which has negative Poisson's ratios is disposed at the heel region 23, the heel region 23 of the upper 2 is stretched in Direction Y simultaneously as it is stretched in Direction X at the time of shape change shown in broken lines in FIG. 14, keeping contact condition between the foot and the upper 2 in the heel region 23, i.e., fitting property of the heel region 23 is not decreased. In addition to the heel region (ankle sponge) 23, a material which has negative Poisson's ratios may also be added to the heel region (heel counter) 24. This further improves fitting property of the heel region of the upper 2.

As a further consideration, when landing on the heel in running activities, the instep region of the foot is compressed in the mediolateral direction and the anterior-posterior direction. As the foot's entire bottom surface lands, the instep region of the foot stretches in the mediolateral direction and the anterior-posterior direction, with the midfoot region being stretched in the mediolateral direction and the anterior-posterior direction on the inner-side while the outer-side of the midfoot region is compressed in the mediolateral direction and the anterior-posterior direction. When the foot kicks on the ground, the instep region of the foot is compressed in the mediolateral direction and the anterior-posterior direction, with the midfoot region compressed in the mediolateral direction and the anterior-posterior direction on the inner-side while the outer-side of the midfoot region is stretched in the mediolateral direction and the anterior-posterior direction. Hence, if a material which has negative Poisson's ratios is inserted to the instep region 21 or the midfoot region 25 of the upper 2, the upper 2 is stretched in both the mediolateral direction and the anterior-posterior direction simultaneously, or compressed in both the mediolateral direction and the anterior-posterior direction simultaneously. In other words, the instep region, the midfoot region and the upper 2 deform their behavior in the same pattern throughout all phases of running activities, and therefore natural movements of the foot is not obstructed by the upper 2.

Next, description will cover an example where the material which has negative Poisson's ratios is used in various places in the upper 2. Reference will be made to FIG. 15 through FIG. 18. In these Drawings, each hatched region represents a region where the material having negative Poisson's ratios is used.

Figure 15:
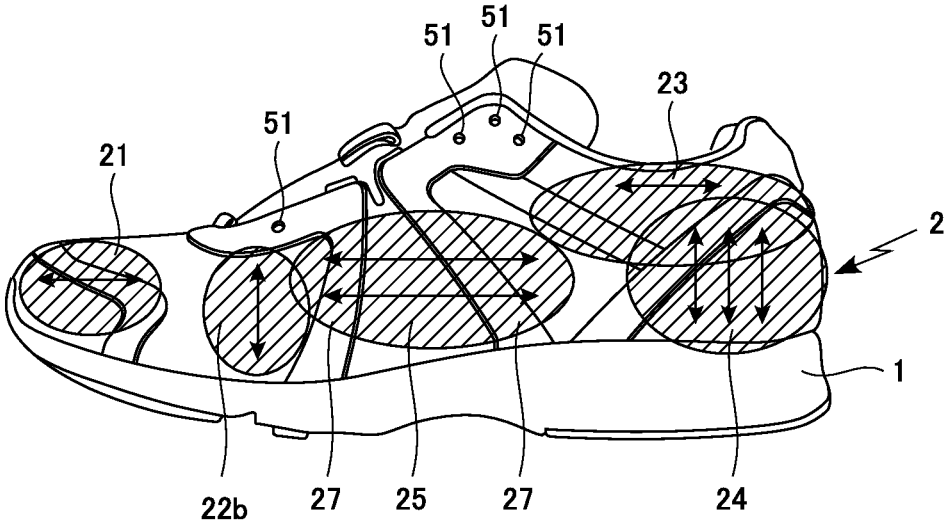
FIG. 15 is a diagrammatic representation showing an example where the material which has negative Poisson's ratios is used in various regions of an inner side of an upper (right foot).
Figure 16:
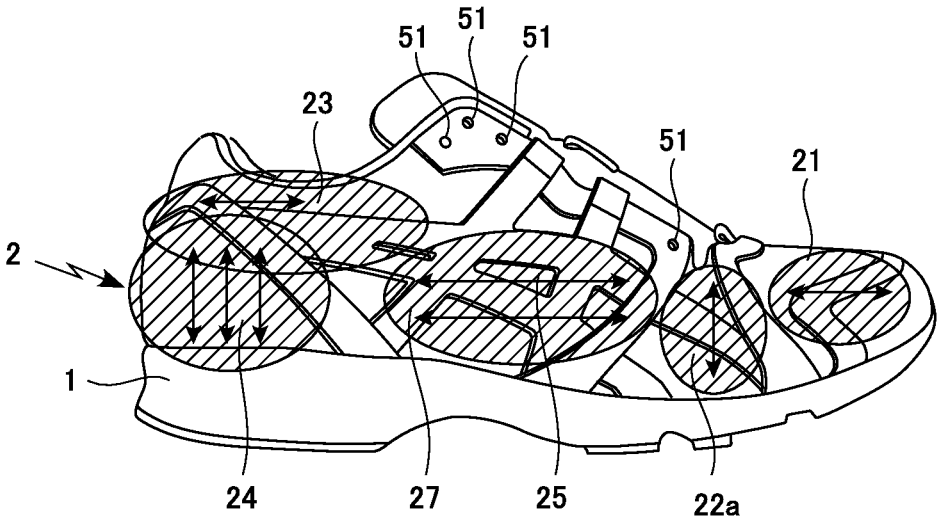
FIG. 16 is a diagrammatic representation showing an example where the material which has negative Poisson's ratios is used in various regions of an outer side of an upper (right foot).
Figure 17:
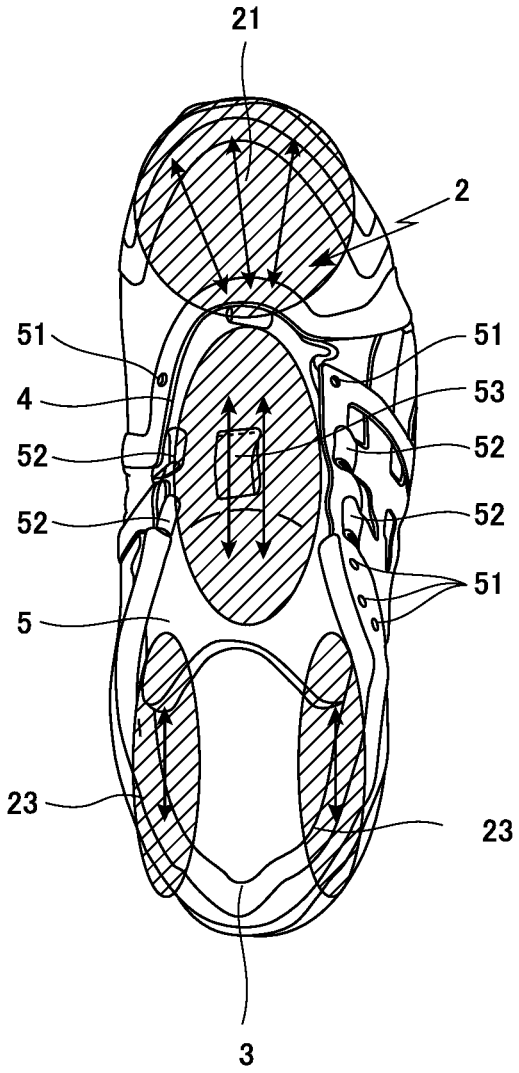
FIG. 17 is a diagrammatic representation showing an example where the material which has negative Poisson's ratios is used in various regions of an upper side of an upper (right foot).

As shown in FIG. 15 through FIG. 17, for the instep region 21 of the upper (right foot) 2, the material 7 having negative Poisson's ratios should be used so that the row direction (indicated by the arrow in the figure) of the negative Poisson's ratios structure is oriented in the fore-aft direction of the shoe. Disposing the material at this place reduces wrinkle occurrence in the instep region 21 when the heel is raised. Also, the foot and the upper 2 deform their behavior in the same pattern in the instep region 21 at the time of landing on the heel, landing on the entire foot bottom surface and kicking on the ground.

As shown in FIG. 15 and FIG. 16, for the fore-foot region 22 (the region of the first metatarsophalangeal joint 22*b* and the region of the fifth metatarsophalangeal joint 22*a*) of the upper 2, the material 7 having negative Poisson's ratios should be used so that the row direction (indicated by the arrow in the figure) of the negative Poisson's ratios structure is oriented in the up-down direction of the shoe. The region of the first metacarpophalangeal metatarsophalangeal joint 22*b* and the region of the fifth metatarsophalangeal joint 22*a* are regions of large contact pressure values and have large influence on pressing contact onto the foot. By providing a material 7 having negative Poisson's ratios at these places, it becomes possible to decrease contact pressure values and improve pressing contact onto the foot. It should be noted here that for movements in lateral directions which are common in such sports as basket ball, succor, etc. the region of the fifth metatarsophalangeal joint 22*a* needs to provide supportability. Therefore, decreased performance can be a concern if a material having negative Poisson's ratios is utilized in the region of the fifth metatarsophalangeal joint 22*a* of shoes designed for basket ball, succor, etc. Appropriate decision should be made depending on the application.

As shown in FIG. 15 through FIG. 17, for the heel region (ankle sponge) 23 of the upper 2, the material 7 having negative Poisson's ratios should be used so that the row direction (indicated by the arrow in the figure) of the negative Poisson's ratios structure is oriented in the fore-aft direction of the shoe. In this case, a sheet of the negative Poisson's ratios material may be rolled and used as a three-dimensional member. Providing the material at this place makes the foot and the upper 2 contact condition each other in the heel region 23 at the time of heel landing in running activities.

As shown in FIG. 15 and FIG. 16, for the heel region (heel counter) 24 of the upper, the material 7 having negative Poisson's ratios should be used so that the row direction (indicated by the arrow in the figure) of the negative Poisson's ratios structure is oriented in the up-down direction of the shoe. Providing the material at this place makes the foot and the upper 2 contact condition each other in the heel region 24 at the time of heel landing in running activities.

As shown in FIG. 17, for the tongue piece 5 of the upper 2, the material 7 having negative Poisson's ratios should be used so that the row direction (indicated by the arrow in the figure) of the negative Poisson's ratios structure is oriented in the fore-aft direction of the shoe. In this case, a sheet of the negative Poisson's ratios material may be rolled and used as a three-dimensional member. Providing the material at this place makes the foot and the upper 2 contact condition each other and improves fitting property.

As shown in FIG. 15 and FIG. 16, for the midfoot region 25 of the upper 2, the material having negative Poisson's ratios should be used so that the row direction (indicated by Arrow in the figure) of the negative Poisson's ratios structure is oriented in the fore-aft direction of the shoe. Providing the material at this place makes the foot and the upper 2 deform their behavior in the same pattern in the midfoot region 25 at the time of landing on the entire foot bottom surface and kicking on the ground during running activities.

Figure 18:
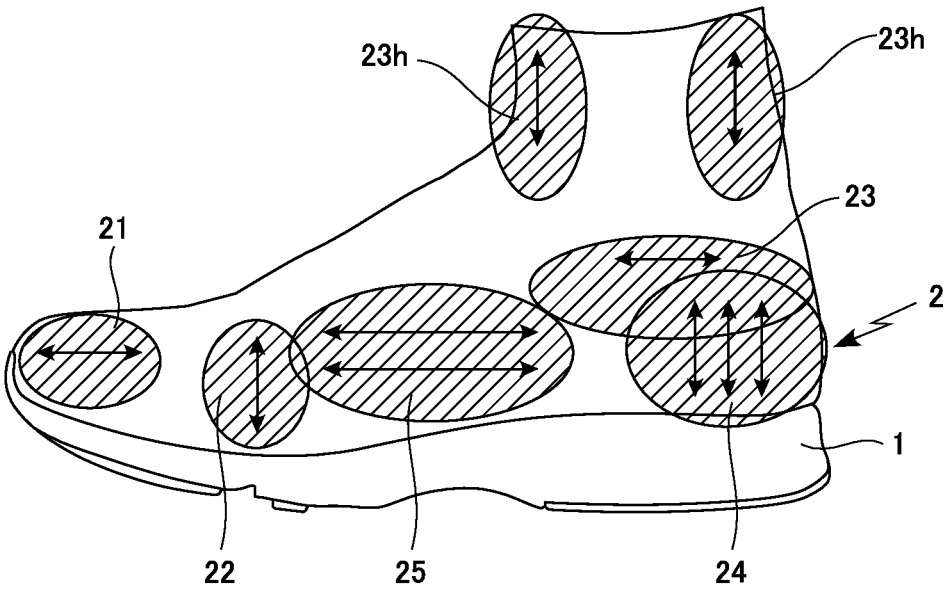
FIG. 18 is a diagrammatic representation showing an example where the material which has negative Poisson's ratios is used in various regions of a high-cut shoe.

FIG. 18 shows an example where the material which has negative Poisson's ratios is applied to high-cut shoes. Except for an ankle regions 23*h*, the negative Poisson's ratios material should be used at the same places in the same orientations as in the above-described examples. For the ankle regions 23*h* of a high-cut shoe, the material having negative Poisson's ratios should be used so that the row direction (indicated by the arrow in the figure) of the negative Poisson's ratios structure is oriented in the up-down direction of the shoe. Providing the material at these places makes the foot and the upper 2 deform their behavior in the same pattern in the ankle region 23*h* at the time when the bottom of the foot is dorsiflexed, keeping the upper 2 not excessively twitched.

In addition to the upper 2, the material should be used as the shoe lace 6 by rolling a sheet of negative Poisson's ratios material into a three-dimensional string. By using the material here, the lace becomes less prone to loosening.

In the embodiments described thus far, the shoe lace 6 is routed through the eyelet regions 51 and the loop regions 52 in the tightening region 50 and then the lace is tightened. Besides such a configuration as the above, the present invention can also be applied to shoes having other lace-tightening designs. Examples include a tightening region 50 provided with buckle (s) so that a belt (s), for example, is inserted through the buckle(s) and then tightened.

All of the embodiments disclosed herein are to show examples, and should not be considered as of a limiting nature in any way. The scope of the present invention is identified by the claims and is not by the descriptions of the embodiments given hereabove, and it is intended that the scope includes all changes falling within equivalents in the meaning and extent of the Claims.

REFERENCE SIGNS LIST

1 Sole
2 Upper
3 First Opening
4 Second Opening
5 Tongue Piece
6 Shoe Lace
7 Material
21 Instep Region
22 Fore-Foot Region
23 Heel Region (Ankle Sponge)
24 Heel Region (Heel Counter)
25 Midfoot region
50 Lace Tightening Region
51 Eyelet Region
52 Loop Region
53 Loop
70 Square-Shaped Frame

The invention claimed is:

1. A shoe comprising:

a sole which absorbs landing impact, having a bottom surface at its lowest portion that contacts to a ground when the shoe lands on the ground; and an upper which covers an instep of a foot, being disposed over the sole; wherein the upper has an opening through which the foot is inserted when wearing the shoe, the opening being surrounded by a tightening region in which a shoe lace is arranged and through which a tightening force is transmitted to the upper from the shoe lace, the upper is made of a combination of a material which has a negative Poisson's ratio in a row direction wherein the material having the negative Poisson's ratio is a negative Poisson material and the Poisson's ratio is a negative value of a quotient given by dividing a lateral strain by a vertical strain when a stretch force is applied to the material in the row direction, the lateral strain being in a perpendicular direction to the row direction and the vertical strain being in the row direction, and another material which does not have a negative Poisson's ratio in any direction, wherein the another material is a positive Poisson material, the upper has a heel region covering a heel of the foot, and seen from a top view of the shoe, the heel region has three portions surrounding the heel and arranged side by side, one being a central portion and the other two being lateral portions that sandwich the central portion in an in-out direction of the shoe, the central portion is made with the positive Poisson material, and the lateral portions are made with the negative Poisson material wherein the row direction of one of the lateral portions is parallel to a fore-aft direction that is parallel to the bottom surface and oriented toward the heel from a toe of the foot.

2. The shoe according to claim 1, wherein seen from the top view of the shoe, the central portion and the lateral portions surround a calcaneus of the foot such that the calcaneus intervenes between the lateral portions in the in-out direction that is perpendicular to the fore-aft direction.

3. The shoe according to claim 2, wherein the row direction of the other of the lateral portions is also parallel to the fore-aft direction of the shoe.

4. The shoe according to claim 3, wherein the upper further has a fore-region covering a fifth metatarsophalangeal joint of the foot, and the fore-region is made with the negative Poisson material, the one of the lateral portions of which the row direction is in the fore-aft direction is arranged on an outer side of the shoe, seen from the top view of the shoe, wherein the one of the lateral portions is an outer lateral portion, the positive Poisson material intervenes between the fore-region and the outer lateral portion, separating the fore-region from the outer lateral portion wherein the negative Poisson material of the outer lateral region is not continuous, in the upper, to the negative Poisson material of the fore-region.

5. The shoe according to claim 4, wherein the row direction of the fore-region is oriented parallel to an up-down direction of the shoe wherein the up-down direction is perpendicular to the bottom surface.

6. The shoe according to claim 3, wherein seen from the top view of the shoe, the two lateral portions are an inner lateral portion, which is arranged on an inner side of the shoe, and an outer lateral portion, which is arranged on an outer side of the shoe, the heel portion further has two supportive portions that are positioned beneath the inner and outer lateral portions, one of the supportive portions being positioned beneath the inner lateral portion and the other of the supportive portions being positioned beneath the outer lateral portion in an up-down direction of the shoe, which is perpendicular to the bottom surface, both of the supportive portions are made with the negative Poisson material, and of which the row directions are oriented parallel to the up-down direction of the shoe.

* * * * *